United States Patent [19]

Norris, Jr. et al.

[11] 3,959,906

[45] June 1, 1976

[54] MESSAGE DISPLAY SYSTEM

[75] Inventors: J. Robert Norris, Jr.; Noa Wasserman, both of Dallas, Tex.

[73] Assignees: J. Robert Norris, Jr.; Noa Wasserman, both of Dallas, Tex.

[22] Filed: June 9, 1975

[21] Appl. No.: 585,296

Related U.S. Application Data

[63] Continuation of Ser. No. 415,642, Nov. 14, 1973, abandoned, which is a continuation of Ser. No. 279,516, Aug. 10, 1972, abandoned.

[52] U.S. Cl. ..... 40/125 A; 40/135

[51] Int. Cl.[2] ..... G09F 3/10; G09F 7/12

[58] Field of Search..... 40/125 A, 125 E, 125 F, 40/135, 129 C, 158 B, 2 R

[56] References Cited

UNITED STATES PATENTS

| | | | |
|---|---|---|---|
| 1,464,753 | 8/1923 | Denoyer | 40/125 F X |
| 1,830,960 | 11/1931 | Philibert | 40/125 A X |
| 2,262,400 | 11/1941 | Laws | 40/125 A |
| 3,338,395 | 8/1967 | Silverstein | 40/125 A X |
| 3,377,728 | 4/1968 | Miller | 40/125 A |
| 3,440,746 | 4/1969 | Richards | 40/125 A |
| 3,526,986 | 9/1970 | Dempnock et al. | 40/125 A |

*Primary Examiner*—Louis G. Mancene
*Assistant Examiner*—John F. Pitrelli
*Attorney, Agent, or Firm*—Richards, Harris & Medlock

[57] ABSTRACT

A message display system comprises a bumper sticker kit including blank bumper stickers and sets of alpha/-numeric display members. Each blank bumper sticker comprises a front display surface having registration thereon and a back surface comprising an adhesive layer which is normally covered by a backing sheet. Each set of alpha/numeric display indicia includes a plurality of letters, numerals, etc. each comprising a front display surface of contrasting color relative to the front display surfaces of the blank bumper stickers and a back surface comprising an adhesive layer which is normally covered by a backing sheet.

In the use of the invention, a message is formed on the front display surface of each blank bumper sticker by removing selected alpha/numeric display members from one of the sets and applying the display members to the front display surface of the blank bumper sticker in accordance with the registration indicia thereon. Thereafter the backing sheet is removed from the blank bumper sticker, whereupon the bumper sticker and the message formed thereon are adhesively displayed from a suitable surface, such as an automobile bumper, or the like.

1 Claim, 5 Drawing Figures

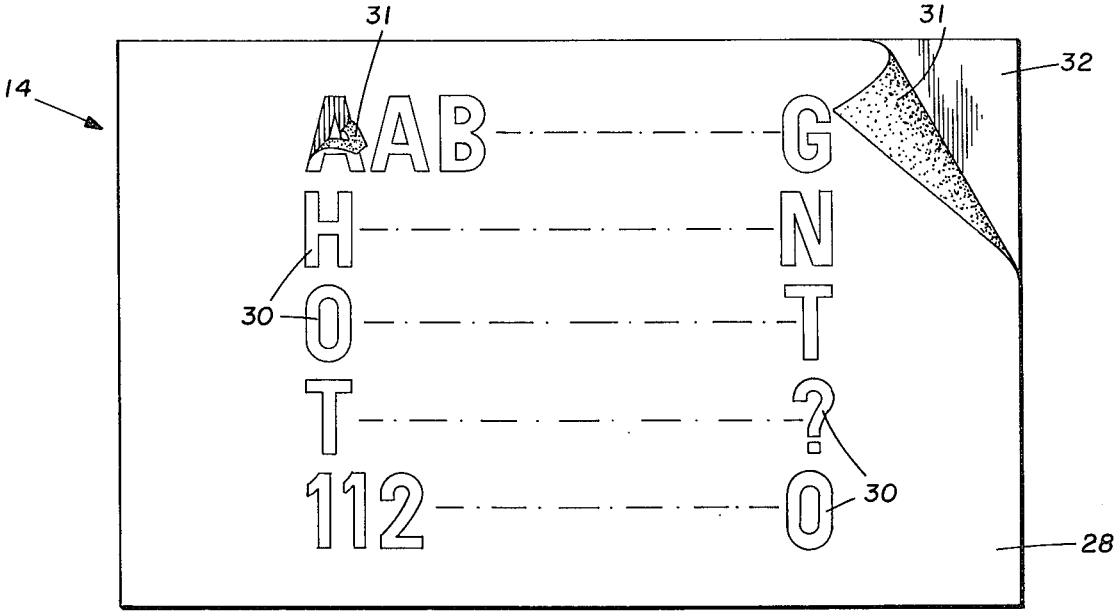
FIG. 3
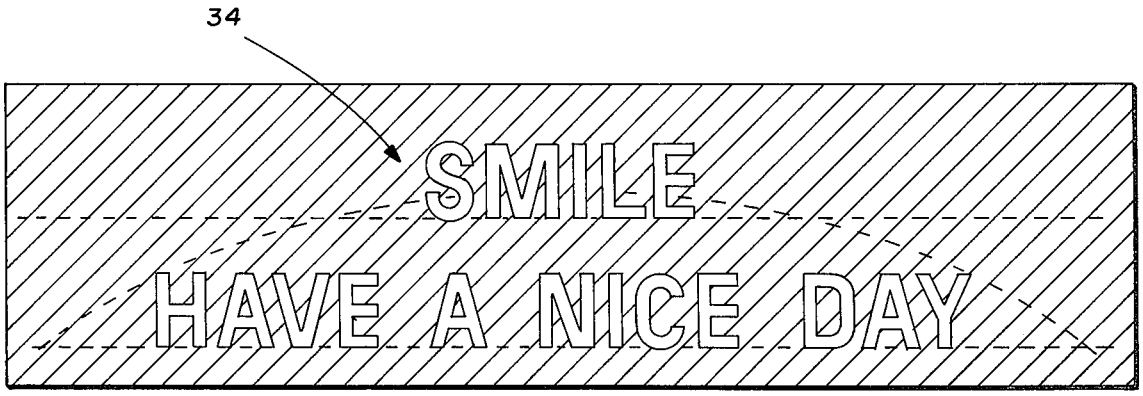
FIG. 4
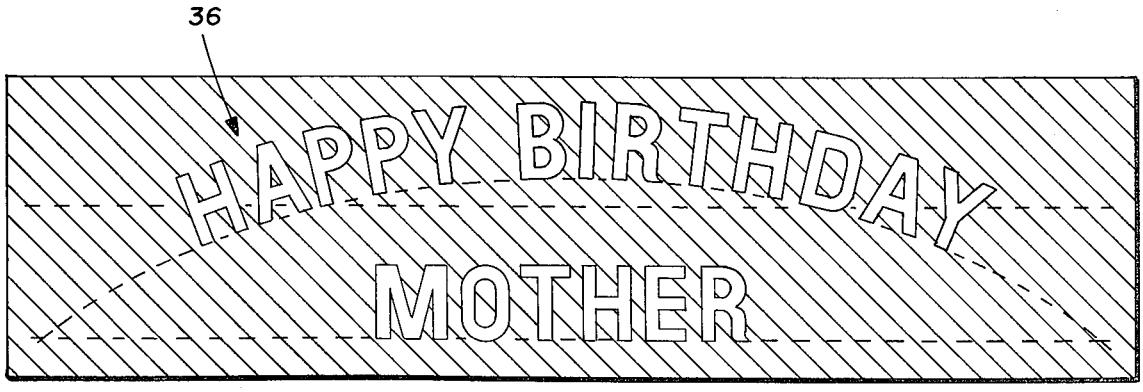

MESSAGE DISPLAY SYSTEM

This is a continuation of application Ser. No. 415,642 filed Nov. 14, 1973, now abandoned, which is a continuation of Ser. No. 279,516 filed Aug. 10, 1972, now abandoned.

BACKGROUND AND SUMMARY OF THE INVENTION

This invention relates to message display systems, and more particularly to a system for displaying custom messages on automobile bumpers and the like.

The current popularity of bumper stickers is well known. Thus, bumper stickers are frequently used for commercial advertising purposes, to promote various political viewpoints, to support both professional and amateur athletic teams, to display serious and humorous slogans of all types, etc. It is also known to provide bumper stickers which are designed to promote various safe-driving practices.

Notwithstanding the popularity of bumper stickers, it has heretofore not been practical to use bumper stickers for the display of custom messages. This is because it has been necessary to use one of the various printing processes in order to make bumper stickers. As is well known, whenever printing is involved it is necessary to amortize relatively high set-up costs over a large number of copies if the total cost per copy is to be kept within reasonable limits.

The present invention comprises a message display system which overcomes the foregoing difficulties. In accordance with the broader aspects of the invention there is provided a kit which may be used to form a desired message on a display surface. By this means custom messages may be displayed on automobile bumpers and in numerous other situations.

More particularly, the invention comprises a bumper sticker kit including at least one blank bumper sticker and a plurality of alpha/numeric display members. In the use of the invention, the alpha/numeric display members are selectively arranged on the blank bumper sticker to form a desired message. Thereafter the bumper sticker is mounted on an automobile bumper or any other desired surface for display of the message.

In accordance with more specific aspects of the invention, the blank bumper sticker includes a front display surface of predetermined size and color and a back surface comprising an adhesive layer. The front surface includes registration indicia which preferably comprise longitudinally extending lines for parallel display of the message and at least one arcuately extending line for arcuate display of the message. The back surface and the adhesive layer formed thereon are normally covered by a backing sheet.

The alpha/numeric display members include the various letters of the alphabet, numerals, punctuation signs, and the like. Each display member comprises a front display surface which is substantially smaller in size and contrasting in color relative to the front display surface of the blank bumper sticker, and a back surface comprising an adhesive layer. A backing sheet normally extends over the back surfaces and the adhesive layers formed thereon of all of the alpha/numeric display members. By this means the backing sheet functions to support the alpha/numeric display members until they are mounted on the front display surface of the blank bumper sticker.

DESCRIPTION OF THE DRAWINGS

A more complete understanding of the invention may be had by referring to the following Detailed Description when taken in conjunction with the accompanying Drawings, wherein:

FIG. 3 is an illustration of a set of alpha/numeric display members comprising part of the message display system shown in FIG. 1; and FIGS. 4 and 5 are illustrations of messages displayed by means of the invention.

DETAILED DESCRIPTION

Figure 1:
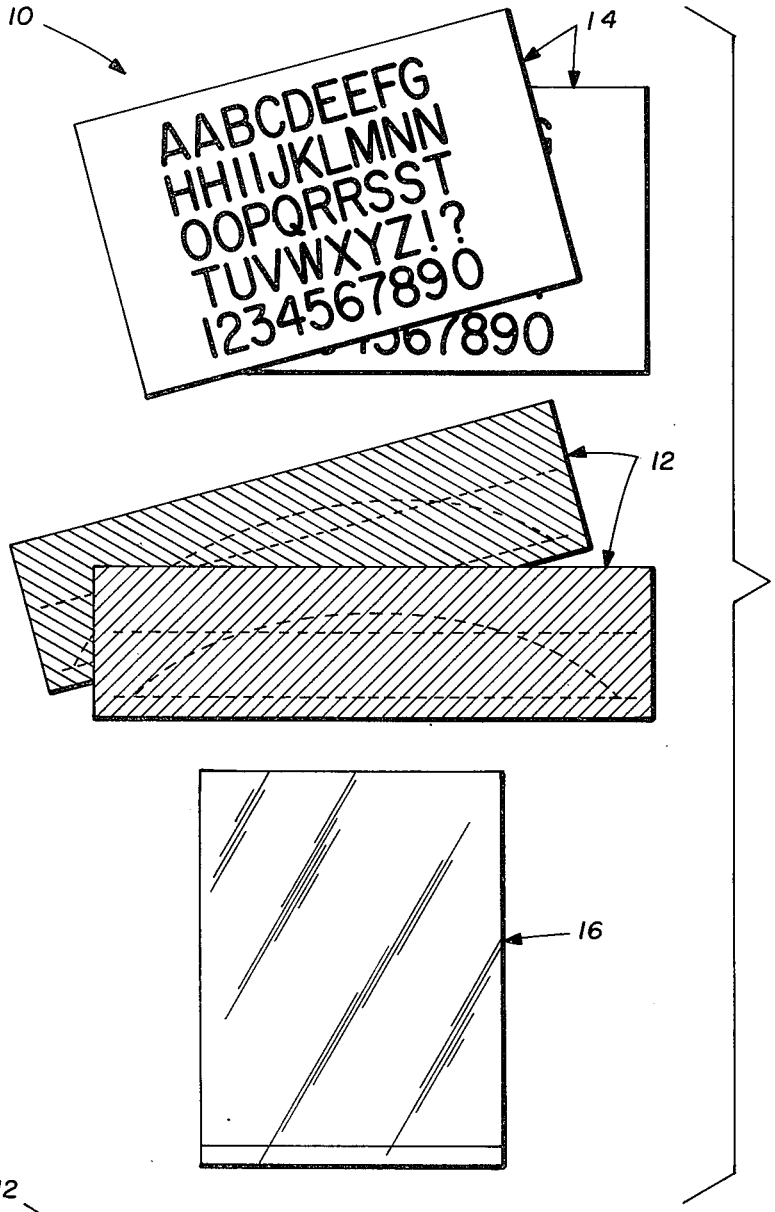
FIG. 1 is an exploded view of a message display system incorporating the invention.

Referring now to the Drawings, and particularly to FIG. 1 thereof, there is shown a message display system 10 incorporating the present invention. The message display system 10 comprises a bumper sticker kit in that it includes at least one, and preferably two blank bumper stickers 12 which may be of contrasting colors, as shown. The system further comprises at least one and preferably two sets of alpha/numeric display members 14. The blank bumper stickers 12 and the sets of alpha/numeric display members 14 comprising the message display system 10 are preferably packaged for distribution and sale in a suitable container, such as the polyethylene bag 16 shown in FIG. 1.

Figure 2:
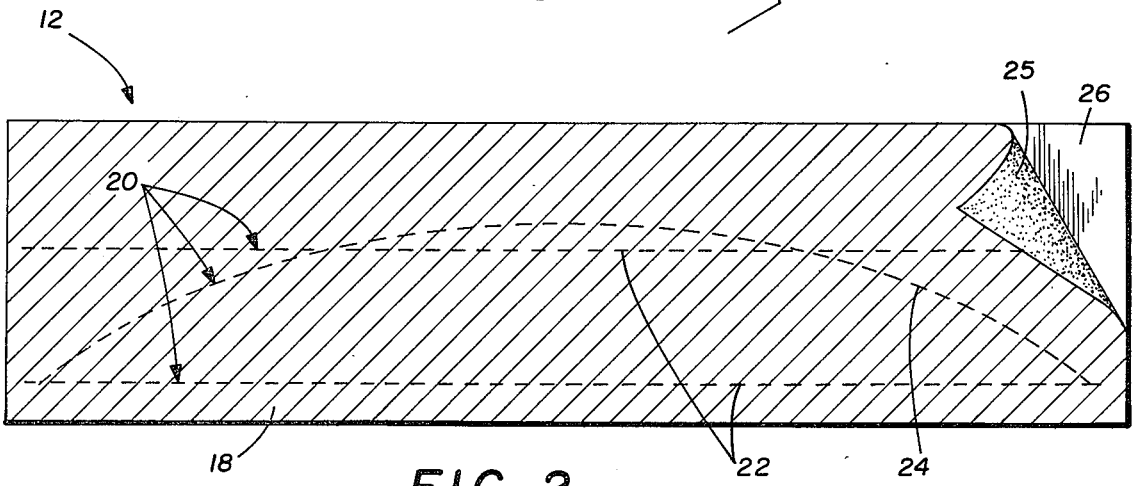
FIG. 2 is an illustration of a blank bumper sticker comprising part of the message display system shown in FIG. 1.

Referring now to FIG. 2, the blank bumper stickers 12 of the message display system 10 are formed from a flexible weather-resistant material, such as the various materials commonly used to make bumper stickers. Each blank bumper sticker 12 comprises a front display surface 18 which is similar in size to a typical bumper sticker, i.e., about 15 inches by about 4 inches. The front display surface 18 of the blank bumper sticker 12 preferably comprises a predetermined color, for example, red, green, blue, etc.

The front display surface 18 of the blank bumper sticker 12 is provided with a plurality of registration indicia 20. In accordance with the preferred embodiment of the invention, the registration indicia 20 comprise a pair of longitudinally extending lines 22 for parallel display of a message and an arcuate line 24 for arcuate display of a message. The arcuate line 24 overlaps the longitudinally extending lines 22, and may be used in conjunction therewith, if desired. Those skilled in the art will appreciate the fact that the present invention may also comprise various types of registration indicia other than those shown in the Drawings.

The blank bumper sticker 12 further comprises a back suface which is provided with an adhesive layer 25. One of the various adhesive materials commonly utilized in the manufacture of bumper stickers is preferably employed in the practice of the present invention. A backing sheet 26 normally extends over the back surface of the blank bumper sticker 12 and the adhesive layer 25 formed thereon. By this means the adhesive layer on the back surface of the blank bumper sticker 12 is protected until such time as the blank bumper sticker is put into use.

The sets of alpha/numeric display members 14 comprising the message display system 10 are illustrated in FIG. 3. Each set includes all of the letters of the alphabet, numerals, and various punctuation signs. As is clearly shown in FIG. 3, various items from each of these groups are repeated within each set 14. Of course, the set of alpha/numeric display members 14 may comprise less than all of the display members illustrated in FIG. 3 and/or different display members, if desired.

The alpha/numeric display members comprising each set 14 are preferably die-cut from a single sheet 28 formed from a weather-resistant material. By this means each alpha/numeric display member comprises a front display surface 30 which is substantially smaller in size than the front display surface 18 of the blank bumper sticker 12. The alpha/numeric display members comprising the sets 14 are also preferably contrasting in color relative to the front display surfaces 18 of the blank bumper stickers 12. For example, in the case of a message system 10 wherein the front display surfaces 18 of the blank bumper stickers 12 are red, blue, green, etc. in color, the front display surfaces 30 of the alpha/numeric display members comprising the sets 14 may be white. Other color combinations may also be utilized in the practice of the invention.

Each alpha/numeric display member further includes a back surface having an adhesive layer 31 formed thereon. The adhesive layer 31 is preferably formed from one of the various adhesive substances which are commonly employed in the manufacture of bumper stickers and similar articles. A backing sheet 32 extends over the back surfaces and the adhesive layers 31 formed thereon of all of the alpha/numeric display members comprising each set 14. By this means the adhesive layers on the alpha/numeric display members are protected until the alpha/numeric display members are put into use. Also, the backing sheet 32 functions to support the various alpha/numeric display members comprising each set 14.

The use of the invention as illustrated in FIGS. 1, 4, and 5. The blank bumper stickers 12 and the sets of alpha/numeric display members 14 are initially folded and are inserted into the polyethylene bag 16. The bag 16 is then closed, such as by staples, heat sealing, etc. By this means the blank bumper stickers 12 and the sets of alpha/numeric display members 14 are retained in the bag 16 during the distribution and delivery of the message display system 10 to the ultimate consumer.

Upon receiving the message display system 10, the consumer opens the polyethylene bag 16 and removes the blank bumper stickers 12 and the sets of alpha/numeric display members 14 therefrom. Thereafter, selected alpha/numeric display members from one of the sets 14 are removed from the backing sheet 32 and are applied to one of the blank bumper stickers 12 to form a desired message. During this action the registration indicia 20 on the front display surface 18 of the blank bumper sticker 12 are utilized to assure proper positioning of the alpha/numeric display members 14 on the surface 18. After all of the alpha/numeric display members comprising the complete message have been applied to the front display surface 18 of the blank bumper sticker 12, the backing sheet 26 is removed from the back surface of the blank bumper sticker 12 and the blank bumper sticker 12 with the message thereon is applied to a suitable surface for display of the message.

Referring now specifically to FIG. 4, there is shown a plurality of alpha/numeric display members arranged on the front display surface of a blank bumper sticker in the parallel format to form a message 34. It should be noted that the area of the front surfaces of the alpha/numeric display members comprising the message 34 is substantially smaller than the area of the front display surface of the blank bumper sticker. This permits the use of a substantial number of alpha/numeric display members in forming the message 34. It should be further noted that the registration indicia on the front display surface of the blank bumper sticker are substantially smaller in size than the alpha/numeric display members which are utilized to form the message 34. By this means the registration indicia are rendered substantially indistinguishable from the remainder of the front display surface of the blank bumper sticker when the message 34 is observed from a distance.

In FIG. 5 there is shown a blank bumper sticker having alpha/numeric display members arranged thereon partially in the arcuate format to form a message 36. As will be appreciated by those skilled in the art, the particular message formats shown in the Drawings are representative only in that any desired message format may be utilized in the practice of the invention. It will be further appreciated that once the message is formed, it may be displayed on various surfaces in addition to automobile bumpers. For example, the present invention can be employed to make signs for use in and around homes and offices, etc., decorations of various types, etc.

From the foregoing, it will be understood that the present invention comprises a kit for use in making bumper stickers and similar small displays. The use of the invention is advantageous in that custom messages may be displayed at a cost which is competitive with that of bumper stickers formed by more conventional means, such as printing, etc. It will be further understood that messages formed by means of the invention may be displayed otherwise than as bumper stickers. Thus, the invention is useful in forming signs and displays for walls and doors, decorations and other displays for lockers, tool boxes and the like, and in various other usages in addition to bumper stickers.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

We claim:

1. A message display system comprising:

blank bumper sticker means including a front display surface having a predetermined area and a predetermined color and a back surface;

an adhesive layer extending over the entire back surface of the blank bumper sticker means;

said front display surface of the blank bumper sticker means comprising reference indicia including at least two spaced apart, longitudinally extending lines for parallel message display and at least one arcuate line overlapping the longitudinal lines for arcuate message display;

first backing sheet means substantially equal in size to the blank bumper sticker means and normally covering the back surface of the blank bumper sticker means and the adhesive layer formed thereon whereby upon removal of the first backing sheet means the blank bumper sticker means may be adhesively mounted on a surface;

a plurality of alpha/numeric display members each comprising a front display surface having a substantially smaller area and a contrasting color relative to the front display surface of the blank bumper sticker means and a back adhesive surface of a shape substantially identical to that of said front display surface;

said reference indicia on the front display surface of the back bumper sticker means being substantially smaller in size than the alpha/numeric display members so as to be substantially indistinguishable from the front display surface when observed from a substantial distance; and second backing sheet means normally extending over the back surfaces of all of the alpha/numeric display members and the adhesive layers formed thereon and thereby normally supporting the alpha/numeric display members whereby upon removal from the second backing sheet means the alpha/numeric display members may be selectively mounted on the front display surface of the blank bumper sticker means to form a desired message;

the front display surfaces of the alpha/numeric display indicia members being substantially smaller in area than the front display surface of the sheet means so that a substantial number of the alpha/numeric display indicia members may be simultaneously mounted on the front display surface of the sheet means to form the message;

both the blank bumper sticker means and the alpha/numeric display members comprising flexible, substantially weather-resistant materials.

* * * * *